US011400557B2

(12) United States Patent
Torvaldsson et al.

(10) Patent No.: US 11,400,557 B2
(45) Date of Patent: Aug. 2, 2022

(54) FLOOR GRINDING MACHINE AND METHOD OF OPERATING FLOOR GRINDING MACHINE

(71) Applicant: HUSQVARNA AB, Huskvarna (SE)

(72) Inventors: Thomas Torvaldsson, Söderköping (SE); Daniel Gustavsson, Söderköping (SE)

(73) Assignee: HUSQVARNA AB, Huskvarna (SE)

( * ) Notice: Subject to any disclaimer, the term of this patent is extended or adjusted under 35 U.S.C. 154(b) by 706 days.

(21) Appl. No.: 16/309,591

(22) PCT Filed: Jun. 1, 2017

(86) PCT No.: PCT/EP2017/063372
§ 371 (c)(1),
(2) Date: Dec. 13, 2018

(87) PCT Pub. No.: WO2017/215943
PCT Pub. Date: Dec. 21, 2017

(65) Prior Publication Data

US 2019/0184514 A1 Jun. 20, 2019

(30) Foreign Application Priority Data

Jun. 14, 2016 (SE) ..... 1650833-5

(51) Int. Cl.
*B24B 7/18* (2006.01)
*B24B 23/02* (2006.01)
(Continued)

(52) U.S. Cl.
CPC ..... *B24B 7/18* (2013.01); *B24B 7/186* (2013.01); *B24B 23/02* (2013.01); *B24B 23/03* (2013.01);
(Continued)

(58) Field of Classification Search
CPC ..... B24B 7/18; B24B 7/186; B24B 23/02; B24B 23/03; B24B 23/04; B24B 49/00; B24B 49/006; B24B 49/10; B24B 49/16
(Continued)

(56) References Cited

U.S. PATENT DOCUMENTS 1,957,790 A * 5/1934 Mavis ..... B24B 23/04 451/351
3,129,539 A * 4/1964 Tempero ..... B24B 7/186 451/353
5,098,506 A 3/1992 Brown et al.
5,398,454 A * 3/1995 Berner ..... B24B 23/04 451/357
(Continued)

FOREIGN PATENT DOCUMENTS

CN 101657296 A 2/2010
CN 105252363 A 1/2016
(Continued)

OTHER PUBLICATIONS

International Search Report for International Application No. PCT/EP2017/063372, dated Aug. 8, 2017 (6 pages).

*Primary Examiner* — Eileen P Morgan
(74) *Attorney, Agent, or Firm* — Burr & Forman LLP

(57) ABSTRACT

This document provides a method of operating a floor grinding machine 100. The method comprises providing a grinding machine 100 comprising a frame 101, a motor 102 and at least one grinding element 1, causing the motor to drive the grinding element so as to rotate at a rotational speed, while in contact with a floor surface to grind, polish or mill the floor surface, determining an actual value of a motor operating parameter, determining a nominal value of the motor operating parameter, comparing the actual value of the motor operating parameter with the nominal value of the motor operating parameter, if a difference between the
(Continued)

actual value of the motor operating parameter and the nominal value of the motor operating parameter exceeds a predetermined difference threshold, determining at least one grinding parameter to be adjusted, and causing the at least one grinding parameter to be adjusted.

18 Claims, 2 Drawing Sheets

(51) Int. Cl.

| | |
|---|---|
| ***B24B 49/10*** | (2006.01) |
| ***B24B 49/16*** | (2006.01) |
| ***B24B 49/00*** | (2012.01) |
| ***B24B 23/03*** | (2006.01) |

(52) U.S. Cl.
CPC ..... *B24B 49/00* (2013.01); *B24B 49/006* (2013.01); *B24B 49/10* (2013.01); *B24B 49/16* (2013.01)

(58) Field of Classification Search
USPC ..... 451/5, 9–11, 21, 350–353
See application file for complete search history.

(56) References Cited

U.S. PATENT DOCUMENTS

| | | | | |
|---|---|---|---|---|
| 5,460,562 | A * | 10/1995 | Lecere | B24B 9/146 451/384 |
| 7,246,023 | B2 | 7/2007 | Bhateja et al. | |
| 7,435,160 | B2 * | 10/2008 | Marrs, III | B24B 7/188 451/11 |
| 8,393,937 | B2 * | 3/2013 | Goldberg | B24B 7/186 451/353 |
| 2005/0164616 | A1 * | 7/2005 | Thysell | B24B 7/186 451/353 |
| 2009/0117833 | A1 * | 5/2009 | Puchegger | B24B 55/102 451/350 |

FOREIGN PATENT DOCUMENTS

| | | | |
|---|---|---|---|
| WO | 0307613 | A1 | 9/2003 |
| WO | 20040105998 | A1 | 12/2004 |
| WO | 20060119518 | A1 | 11/2006 |
| WO | 2008019050 | A1 | 2/2008 |
| WO | 2012076087 | A1 | 6/2012 |
| WO | 2016064333 | A1 | 4/2016 |

* cited by examiner

FLOOR GRINDING MACHINE AND METHOD OF OPERATING FLOOR GRINDING MACHINE

CROSS-REFERENCE TO RELATED APPLICATIONS

This application claims priority to International Application No. PCT/EP2017/063372, flied Jun. 1, 2017 and titled "FLOOR GRINDING MACHINE AND METHOD OF OPERATING FLOOR GRINDING MACHINE," which in to claims priority from a Swedish Application having serial number 1650833-5, filed Jun. 14, 2016, and titled "FLOOR GRINDING MACHINE AND METHOD OF OPERATING FLOOR GRINDING MACHINE," both of which are incorporated herein by reference in their entireties.

TECHNICAL FIELD

The present disclosure relates to methods of operating floor grinding machines, and in particular for operating floor grinding machines adapted for grinding floors of stone or stone-like materials, such as limestone, sandstone, marble, slate, granite, concrete or terrazzo.

BACKGROUND

Floor grinding machines are known and used in polishing or grinding floor surfaces, either with the purpose of producing a level and/or glossy floor surface, or with the purpose of renovating such a surface which has deteriorated due to e.g. wear, or which has been damaged.

A floor grinding machine for this type of grinding typically comprises a machine frame, which carries a motor that is operatively connected to a grinding head.

In a particular class of floor grinding machines, such a grinding head may be rotatable relative to the machine frame. The grinding head may carry a plurality of grinding disks, each of which may be rotatable relative to the grinding head. Such a grinding head is typically referred to as a planetary type grinding head.

These floor grinding machines are usually equipped with grinding elements in the form of bonded abrasives, i.e. abrasives in the form of a three-dimensional body comprising abrasive particles and a matrix material, which may be a polymer material or a metallic material. As another option, the machines may be equipped with cutting elements, adapted, for example for removal of glue, paint, lacquer or other surface treatments from a floor surface.

The machine may typically be supported by its grinding head and often also by a pair of wheels, which may be arranged behind the grinding head, as seen in a forward direction of the machine. Optionally, the machine may also be supported by one or more further wheels, which may be used to control the pressure exerted by the grinding head on the floor.

The pair of wheels may be driven. Optionally, they may be individually drivable, such that a direction of travel of the machine may be controlled.

The floor grinding machine may comprise a handle, which is connected to the frame and provides possibility for the operator to hold, push, pull and/or steer the machine.

One example of a known machine of this type is disclosed in WO03076131A1.

When grinding a floor as discussed above, it is of interest to optimize the grinding procedure, so as to provide the best possible trade-off between productivity (e.g. area/time) and tool wear.

Today, much of this is achieved by the operator sensing how the process is functioning. For example, the operator may be able to feel or hear how the machine is operating, in addition, of course, to seeing the result of the grinding or polishing process.

However, there would be advantages in not only having to rely on the operator's skill and level of attention. Moreover, it would be advantageous to provide further assistance also to skilled and attentive operators.

There is thus a need for further assistance to the operator in assessing the status of the grinding or polishing process, such that he or she can make better decisions on how to handle the grinding machine.

SUMMARY

An object of the present disclosure is to provide an improved method of operating a floor grinding machine for grinding floor surfaces of stone or stone-like materials.

A particular object is to provide a method which assists the operator in assessing the status of the grinding or polishing process.

The invention is defined by the appended independent claims, with embodiments being set forth in the appended dependent claims in the following description and in the attached drawings.

According to a first aspect, there is provided a method of operating a floor grinding machine. The method comprises providing a grinding machine comprising a frame, a motor and at least one grinding element, causing the motor to drive the grinding element so as to rotate at a rotational speed, while in contact with a floor surface to grind, polish or mill the floor surface, determining an actual value of a motor operating parameter, determining a nominal value of the motor operating parameter, comparing the actual value of the motor operating parameter with the nominal value of the motor operating parameter, if a difference between the actual value of the motor operating parameter and the nominal value of the motor operating parameter exceeds a predetermined difference threshold, determining at least one grinding parameter to be adjusted, and causing the at least one grinding parameter to be adjusted.

By comparing an actual value with a nominal value of a machine operating parameter, it is possible to derive information on whether the grinding process is successful or not.

For example, low torque exerted by the grinding machine may indicate poor engagement with the floor surface and thus unsatisfactory removal of material.

On the other hand, high torque may indicate excessive removal of material, excessive tool wear or excessive grinding pressure.

Moreover, low power provided by the machine as compared to nominal power may indicate that the full potential of the machine is not being used. That is, that it would be possible to operate at higher speed to increase productivity.

By comparing an actual value with a nominal value of a machine operating parameter, it is possible to derive information on whether the grinding process is successful or not.

Determining the actual value of the motor operating parameter may comprise measuring a value of the motor operating parameter and deriving the actual value of the motor operating parameter based on the value measured.

Determining the actual value of the motor operating parameter may comprise determining a rotational speed of the motor, and determining a motor efficiency at the rotational speed, whereby the actual value of the motor operating parameter is determined as the measured value adjusted by the efficiency.

The efficiency may be calculated or derived from an empirically provided data set, indicating efficiency as a function of rotational speed.]

Determining the nominal value of the motor operating parameter may comprise determining the rotational speed of the motor, and determining the nominal value of the motor operating parameter at the rotational speed by calculation or table lookup based on the rotational speed.

The method may further comprise determining a motor efficiency based on the rotational speed, and determining the nominal value of the motor operating parameter as the nominal value of the motor operating parameter at the rotational speed, adjusted by the efficiency.

The difference threshold is set to less than 30% of the amount of the difference between the theoretical power and the actual power, preferably less than 25%, less than 20% or less than 15%.

The method may further comprise adjusting the difference threshold based on a tool type.

The parameter may be a motor current, a motor torque or a motor power.

The motor current may be measured directly on the motor, or provided as a parameter from a control unit.

The motor power input may also be measured directly (e.g. current and voltage), or it may be provided as a parameter from the control unit.

The torque may be derived based on e.g. the current, or it may be measured by use of e.g. a torque measurement device.

As one option, the method may comprise causing the grinding parameter to be adjusted by a control circuit and/or control software of the floor grinding machine in response to a determination that the grinding parameter is to be adjusted.

In the method, automatically adjusting the grinding parameter may comprise at least one of adjusting a grinding head rotational speed, changing a grinding head direction of rotation, adjusting a grinding disc rotational speed, changing a grinding disc direction of rotation, changing a machine forward movement speed, changing a pressure or flow of a collection device connected to the grinding machine, adjusting a grinding pressure, initiating, terminating or adjusting a supply of liquid, initiating, terminating or adjusting a supply of aerosol.

As another option, the method may comprise causing the grinding parameter to be adjusted by prompting an operator of the floor grinding machine to adjust the grinding parameter.

Prompting the operator to adjust the grinding parameter may comprise indicating, via a user interface, one or more grinding control parameters to be adjusted.

The method may further comprise receiving a user input indicating that at least one of the indicated grinding control parameters has been adjusted.

In the method, causing the at least one grinding parameter to be adjusted may include at least one of adjusting a grinding head rotational speed, changing a grinding head direction of rotation, adjusting a grinding disc rotational speed, changing a grinding disc direction of rotation, changing a machine forward movement speed, changing a pressure or flow of a collection device connected to the grinding machine, adjusting a grinding pressure, initiating, terminating or adjusting a supply of liquid, initiating, terminating or adjusting a supply of aerosol, and changing a grinding tool.

In the method, determining the grinding parameter to be adjusted may comprise determining a torque produced by the motor, comparing the torque produced with a desired torque range, and if the torque produced is outside the desired torque range, proceeding with causing the grinding parameter to be adjusted.

In the method, if the torque produced is below the desired torque range and the grinding process is a dry grinding process, the method may further comprise increasing a grinding pressure, activating an aerosol supply, and/or reducing a flow to a dust collector, operatively connected to the grinding machine.

If the torque produced is below the desired torque range and the grinding process is a wet grinding process, at least one of the following steps may be carried out increasing a grinding pressure, or increasing a water feed rate.

If, after a predetermined period from the carrying out of said increasing steps, a re-determined torque remains below said predetermined low torque threshold, the method may further comprise adjusting a grinding head rotation speed, changing a grinding head rotation direction, adjusting a grinding disc rotation speed, or changing a grinding disc rotation direction.

If the torque produced is above the desired torque range and the grinding process is a dry grinding process, the method may further comprise decreasing a grinding pressure, and/or deactivating an aerosol supply.

If the torque produced is above the desired torque range and the grinding process is a wet grinding process, the method may further comprise decreasing a grinding pressure, and/or reducing a water feed rate.

If, after a predetermined period, a re-measured torque is still below a low torque threshold, or above a high torque threshold, the method may further comprise prompting an operator of the floor grinding machine to at least one of change tool, or change grinding process from dry to wet or vice versa.

The step of determining a nominal value of the motor operating parameter may comprise receiving a user input indicating that the grinding, polishing or milling is operating as desired, determining a current value of the motor operating parameter, and setting the nominal value of the motor operating parameter based on the determined current value of the motor operating parameter.

Such method may further comprise measuring the current value of the motor operating parameter for a predetermined time at the time of receipt of the user input, whereby a series of current values of the motor operating parameters are recorded, and setting the nominal value based on said series of current values.

According to a second aspect, there is provided a floor grinding machine for grinding or polishing floor surfaces of stone or stone-like material, comprising a machine frame, a motor, supported by the machine frame, a grinding head, supported by the machine frame and operatively connected to the motor, such that the grinding head is rotatably drivable by the motor, a user interface, configured to provide information to the user and to receive user inputs, a control circuit connected to the user interface and configured to control the motor based on received sensor signal.

The control circuit is further configured to compare an actual value of at least one motor operating parameter with a nominal value of the motor operating parameter, if a difference between the actual value of the motor operating parameter and the nominal value of the motor operating parameter exceeds a predetermined difference threshold, determine at least one grinding parameter to be adjusted, and cause the at least one grinding parameter to be adjusted.

DETAILED DESCRIPTION

Figure 1:
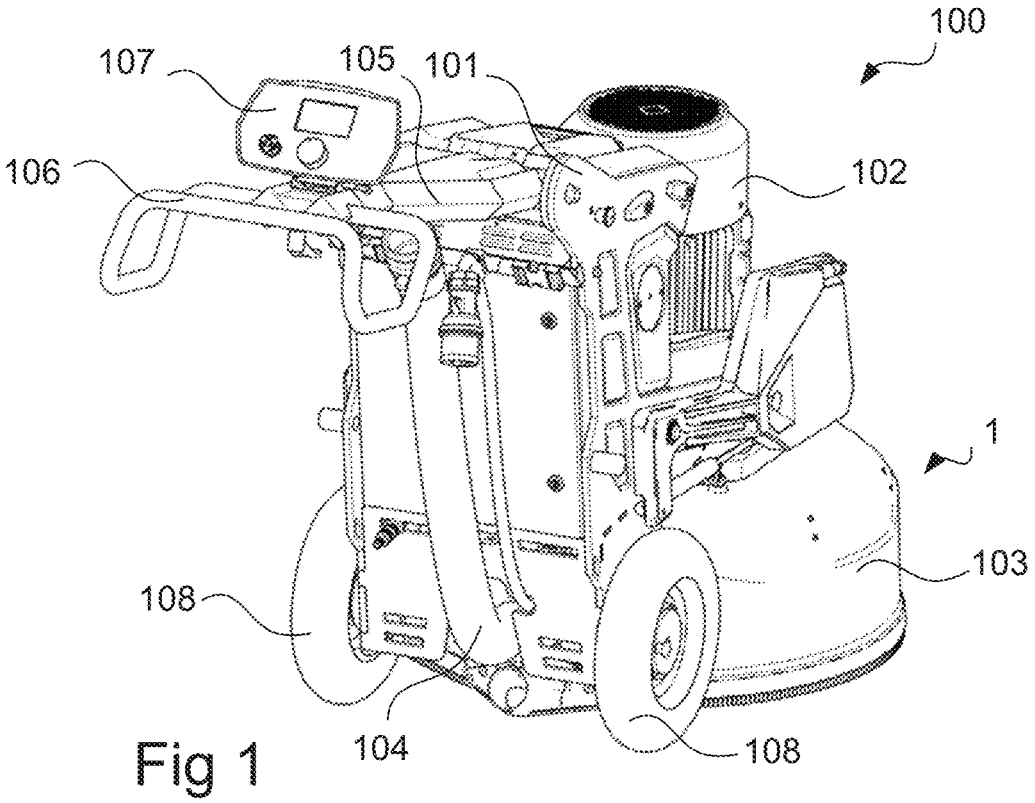
FIG. 1 schematically illustrates a floor grinding machine, which is suitable for grinding, polishing or milling floor surfaces.

FIG. 1 schematically illustrates a floor grinding machine 100. The grinding machine 100 comprises a machine frame 101 which supports a grinding head 1 and a motor 102. The grinding head 1 is driven by the motor 102 to rotate.

The grinding head 1 as illustrated herein is formed as a planetary type grinding head, i.e. the grinding head casing is rotatable relative to the machine frame 101, and in turn carries two or more grinding disks, each of which being rotatable relative to the casing. Typically, a grinding machine comprises three or more grinding disks, often 3, 4 or 6.

Each of the grinding disks may carry one or more grinding elements, which may be releasably attachable to the grinding disk.

The grinding elements may be formed as "bonded abrasives", i.e. abrasive particles engulfed in a matrix material, or as "coated abrasives", i.e. abrasive particles attached to a carrier surface by a binder.

The matrix or binder material may be a polymer material, such as a polymeric material, or a metallic or ceramic material. Non-limiting examples include thermosetting polymeric materials, and two-component type polymeric materials such as epoxy.

Tools having cutting edges or crushing elements instead of, or in addition to, grinding elements, may also be used.

The grinding head 1 may comprise a casing, which is rotatable inside a hood 103. The casing may enclose the transmission mechanism for achieving the above mentioned rotational movements.

The hood 103 may be arranged to enclose the grinding head 1, such that grinding residues are contained and can be readily collected by e.g. a collection device as will be further described.

The machine 100 may thus further comprise a collection device for collecting grinding residues, such as dust, water and the like. The collection device may comprise a hood connector, such that a space enclosed by the hood is in fluid connection with a dust collector, and optionally a channel, such as a hose or a pipe 104. A hose 104 leading to the dust collector, such as a vacuum cleaner, may be directly connectable to the hood connector, or to the channel.

The machine 100 may further comprise a handle frame 105 extending from an upper rear portion of the machine frame 101. The handle frame 105 may support a handle 106 for a user to grip and/or steer the machine 100, and optionally a user interface 107.

The user interface 107 may comprise an output device, such as a display, which may be a touch screen, for displaying information. The user interface may further comprise one or more input devices, such as a touch screen, buttons, knobs and/or a keyboard for the user to control the machine 100.

Figure 2:
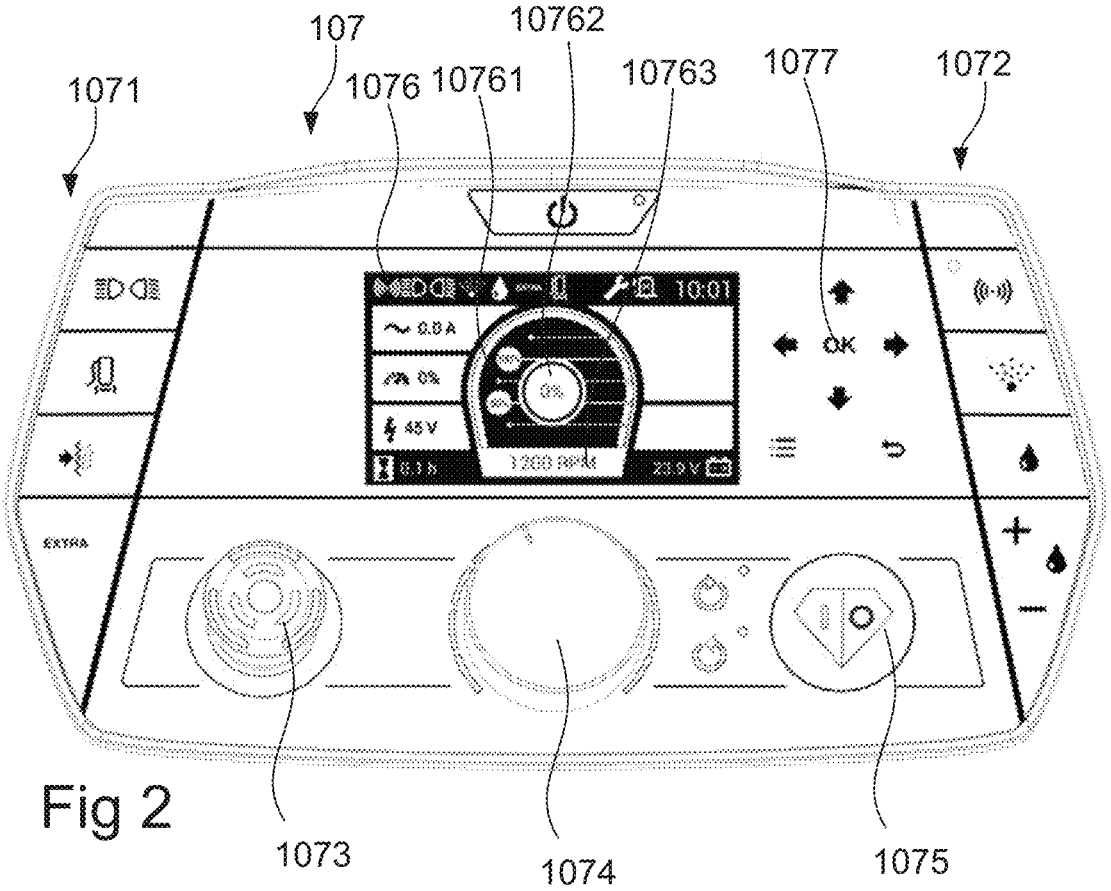
FIG. 2 schematically illustrates a user interface, which is suitable for the floor grinding machine in FIG. 1.

FIG. 2 schematically illustrates a user interface of the floor grinding machine of FIG. 1. The user interface comprises a plurality of function specific switches 1071, 1072; an emergency stop button 1073; a rotary input device 1074 and a power switch 1075. The user interface may further comprise a display 1076, which may indicate, inter alia, actual power 10761, actual power as percentage of nominal power 10762 and rotary speed 10763. Moreover, the user interface may comprise a function selection input 1077, which may include real or virtual buttons for maneuvering in selection menus.

The machine 100 may be supported by wheels, such as by a pair of coaxial wheels 108. The wheels may provide part of the support, with additional, or even most, support provided by the grinding head 1.

The wheels may be freely rotatable, whereby the machine 100 may be propelled entirely by being pushed and/or pulled by the user.

As another option, the wheels may be driven by one or more drive motors. For example, the wheels may be individually drivable, whereby steering of the machine 100 by e.g. radio control may be enabled. As yet another example, one or more additional drive wheels may be provided.

The machine may be capable of controlling grinding pressure, i.e. the force exerted between the grinding head and the ground beneath it.

One way of achieving this is through a balancing arrangement, whereby a counter weight is adjustable, such that it will balance against the grinding head about the wheel axis.

Another way is to provide an additional support wheel or caster, e.g. in front of the grinding machine, and to provide this support wheel with a height adjustment mechanism, such that the force may be adjustably divided between the support wheel and grinding head.

Yet another way may be to use a frame composed of two or more parts that are movable relative to each other, such that a center of gravity may be shifted.

Yet another way may be entirely manual, i.e. to add or remove weights on the grinding head.

The machine 100 may comprise a control unit, which includes circuitry and/or software for controlling the machine 100 and/or feeding back information, such as setting a speed of the rotating discs, and reporting a temperature of the motor and/or grinding discs.

The motor may be an electrically powered motor. Such motors typically have a nominal power rating, i.e. an indication of a drive power at which the motor, with some safety margin, is expected to be able to operate over a significant amount of time. It is recognized, that this nominal power rating may sometimes be exceeded for a limited period of time.

The control unit may typically comprise a frequency converter.

Figure 3:
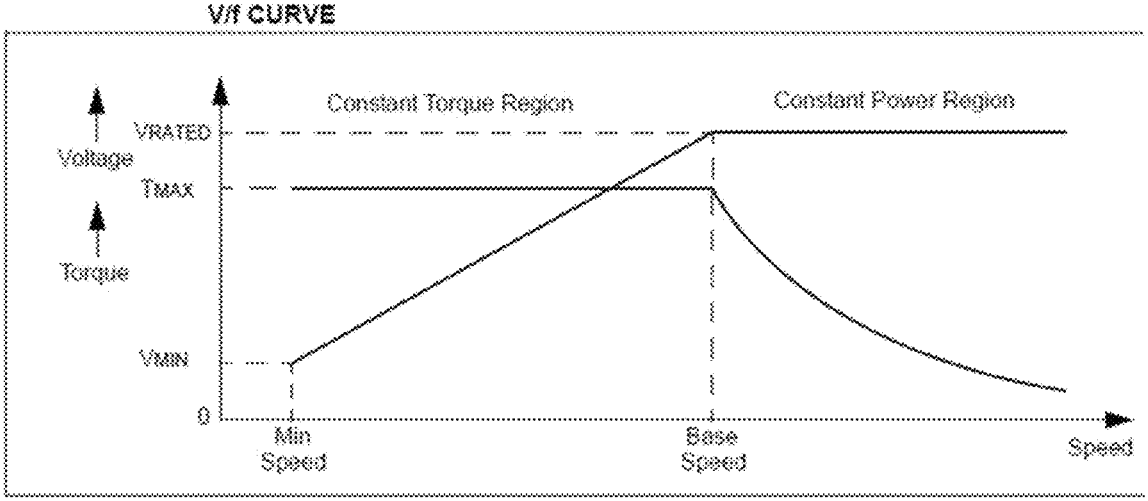
FIG. 3 is a schematic diagram showing power and torque as functions of motor speed, with motor efficiency being disregarded.

Referring to FIG. 3, operating characteristics of a motor for use in a floor grinding machine is disclosed, with voltage as a function of rotational speed. As can be seen, the motor may effectively have a minimum operating speed and a base speed at a voltage that corresponds to the machine's rated voltage or "nominal voltage".

It is noted that for frequency controlled asynchronous motors, up to the motor's base speed, its torque is substantially constant. Exceeding the base speed, the motor's torque decreases.

Moreover, up to the base speed, the power of the motor varies linearly with the rotational speed. Exceeding the base speed, the power remains substantially constant.

The control unit may be equipped with the capability of sensing drive current, drive voltage and rotational speed. Additional sensors, such as temperature sensors, torque sensors, pressure sensors, etc. may be provided.

It is possible to compare the power provided by the motor as compared to nominal power in order to determine whether the motor is operating sufficiently near an optimum.

The nominal power provided by the machine is normally known, as it is based on an inherent property of the motor.

If the ratio of actual power to nominal power is low, this may indicate that the grinding process is not running optimally, e.g. that the speed is too low or that the friction, and thus the torque is too low.

If, on the other hand, the actual power to nominal power is high, this may also indicate that the grinding process is not running optimally, e.g. that the speed is too high or that the friction, i.e. the force counteracting the grinding elements' movement relative to the floor surface, is too high.

The rotational speed is normally available via the control unit, but can additionally, or alternatively, be measured in any known way.

It is possible to determine an efficiency $\eta$ of the motor. Typically, such determination can be made empirically, in a test setup, whereby a lookup table can be provided indicating the efficiency $\eta$ as a function of motor speed (rpm). As an alternative, the efficiency $\eta$ as a function of speed can be determined by e.g. interpolation.

Initially, the description will focus on a method of operating a floor grinding machine, wherein actual power produced by the machine is compared to the machine's nominal power at that rotation speed.

Hence, the machine will measure the actual power fed to the motor, either by measuring current and voltage, or by directly providing the value of the power, as may be possible when using a modern variable frequency drive/frequency inverter.

Moreover, the rotational speed is measured, or provided directly by the frequency converter.

As can be seen in FIG. 3, the power provided will be linearly proportional to the speed.

Using the rotational speed, a lookup table may be consulted to derive the nominal power for that rotational speed.

A ratio of actual power to nominal power may then be derived.

If this ratio is low, such as below 75%, below 80% or below 85%, as the case may be, an action to increase actual power may be taken.

One such action may be to increase rotational speed.

Likewise, if the ratio is high, such as above 125%, above 120% or above 115%, an action to decrease actual power may be taken.

One such action may be to decrease rotational speed.

At this point, it may also be desirable to derive the torque provided by the motor in comparison with a nominal torque available at that rotational speed.

The actual torque may be provided based on the formula:

$$\text{Power}_{actual}=\text{torque}\times\text{rpm}$$

Since the actual power and the rotational speed, rpm, are known, the torque can be derived. This torque may then be compared to the nominal torque that the machine can provide at the relevant rotational speed.

A ratio of actual torque to nominal torque may then be provided.

If the torque ratio is low, this may indicate that the friction between the tool and the floor surface is low.

If the torque ratio is high, this may indicated that the friction between the tool and the floor surface is high.

A range of acceptable torques may be provided, such as 80-120% of nominal torque, whereby adjustments are made only if the actual torque is outside that range.

In the event the actual torque is below the desired torque range and the grinding process is a dry grinding process, at least one of the following steps may be carried out.

As a first option, a grinding pressure may be increased, that is, e.g. the weight applied onto the grinding head may be increased. This may be done by applying additional weights to the grinding head, which may call for the user being prompted to add more weight. As another option, the grinding head may be rebalanced, relative to a wheel axis, or a support wheel may be slightly raised, such that the weight on the grinding head is increased.

As yet another option, an aerosol supply, that is, a device for applying coolant to the tools, which may reduce the risk of tool glazing, may be activated or adjusted to increase amount of aerosol applied.

As another option, it is possible to reduce a flow to a dust collector that is connected to the grinding machine.

If, on the other hand, the actual torque is below the desired torque range and the grinding process is a wet grinding process, at least one of the following steps may be carried out.

The grinding pressure may be increased, as was described above.

As another option, or alternative, a water feed rate could be increased.

At this point, the process, wet or dry, may continue for a period of time, such as for 30 seconds to 15 minutes, after which a new measurement is made.

If this new measurement indicates that the torque is still too low, then a grinding speed may be adjusted.

For example, a grinding head rotation speed may be adjusted, a grinding head rotation direction may be changed, a grinding disc rotation speed may be adjusted, or a grinding disc rotation direction may be changed.

If, on the other hand, the actual torque is above the desired torque range and the grinding process is a dry grinding process, at least one of the following steps may be carried out.

A grinding pressure may be decreased, on a manner opposite to what was described above.

Additionally, an aerosol supply could be reduced or turned off.

On the other hand, if the torque produced is above the desired torque range and the grinding process is a wet grinding process, at least one of the following steps may be carried out:

The grinding pressure may be decreased.

Alternatively, or additionally, a water feed rate could be reduced.

In either case, if, after a predetermined period, the remeasured torque is still below a low torque threshold, or above a high torque threshold, the user may be prompted to carry out at least one of the following steps: change tool, and/or change grinding process from dry to wet or vice versa.

It is understood that, although the present disclosure is directed to grinding machines using planetary type grinding heads, the measurement and control principles disclosed herein may also be applied to other types of grinding machines, including single disc type grinding machines and grinding machines having multiple grinding heads.

As an option to using a predetermined nominal value of a motor operating parameter, such as current, torque or power, it may be possible to set one in response to an operator input provided when the machine is running properly.

Hence, the user may indicate when the machine is running properly, whereby the machine may measure a value of the parameter, or a series of values of the parameter, and determine the nominal value based on this measured value or series of values.

For example, the machine may continuously measure and save the parameter value, such that measured values may be taken during a predetermined time up until, around or from the user input.

The measured values may be used to provide an average value, which may form the nominal value. Acceptance of such nominal value by the machine may be subject to e.g. a limit on its standard deviation.

The invention claimed is:

1. A method of operating a floor grinding machine, comprising:

providing a grinding machine comprising a frame, a motor operably coupled to the frame and a grinding element operably coupled to the motor, causing the motor to drive the grinding element so as to rotate the grinding element at a rotational speed, while the grinding element is in contact with a floor surface to grind, polish or mill the floor surface, determining an actual value of a motor operating parameter comprising current, torque or power by:

measuring a measured value of the motor operating parameter and deriving the actual value of the motor operating parameter based on the measured value, determining a rotational speed of the motor, determining a motor efficiency of the motor at the rotational speed, and determining the actual value of the motor operating parameter as the measured value adjusted by the motor efficiency, determining a nominal value of the motor operating parameter at the rotational speed, comparing the actual value of the motor operating parameter with the nominal value of the motor operating parameter, responsive to a difference between the actual value of the motor operating parameter and the nominal value of the motor operating parameter exceeding a predetermined difference threshold, determining a grinding parameter to be adjusted, and causing the grinding parameter to be adjusted.

2. The method as claimed in claim 1, wherein determining the nominal value of the motor operating parameter comprises determining the nominal value of the motor operating parameter at the rotational speed by calculation or table lookup based on the rotational speed.

3. The method as claimed in claim 2, wherein the lookup table provides the motor efficiency at the rotational speed and the nominal value of the motor operating parameter is adjusted by the motor efficiency.

4. The method as claimed in claim 1, wherein the predetermined difference threshold is set to less than 30% of an amount of a difference between a nominal value of power and an actual value of power.

5. The method as claimed in claim 4, further comprising adjusting the predetermined difference threshold based on a tool type.

6. The method as claimed in claim 1, wherein causing the grinding parameter to be adjusted includes adjusting the grinding parameter by a control circuit of the floor grinding machine in response to determination that the grinding parameter is to be adjusted.

7. The method as claimed in claim 1, wherein causing the grinding parameter to be adjusted includes prompting an operator of the floor grinding machine to adjust the grinding parameter.

8. The method as claimed in claim 7, wherein prompting the operator to adjust the grinding parameter comprises indicating, via a user interface, an instruction to the operator with respect to how to adjust the grinding parameter.

9. The method as claimed in claim 8, further comprising receiving a user input indicating that the grinding parameter has been adjusted.

10. The method as claimed in claim 1, wherein causing the grinding parameter to be adjusted comprises:

determining a torque produced by the motor, comparing the torque produced with a desired torque range, and if the torque produced is outside the desired torque range, instructing an operator to adjust the grinding pressure.

11. The method as claimed in claim 10, wherein, responsive to the torque produced being below the desired torque range and the grinding process being a dry grinding process, the method further comprises:

increasing a grinding pressure, activating or increasing an aerosol supply, and reducing a flow to a dust collector, operatively connected to the grinding machine.

12. The method as claimed in claim 10, wherein, responsive to the torque produced being below the desired torque range and the grinding process being a wet grinding process, the method further comprises:

increasing a grinding pressure, and increasing a water feed rate.

13. The method as claimed in claim 10, wherein, responsive to a predetermined period elapsing after the causing the grinding parameter to be adjusted, and a re-determined torque remaining below a predetermined low torque threshold, the method further comprises:

adjusting a grinding head rotation speed, changing a grinding head rotation direction, adjusting a grinding disc rotation speed, and changing a grinding disc rotation direction.

14. The method as claimed in claim 10, wherein, responsive to the torque produced being above the desired torque range and the grinding process being a dry grinding process, the method further comprises:

decreasing a grinding pressure, and deactivating or decreasing an aerosol supply.

15. The method as claimed in claim 10, wherein, responsive to the torque produced being above the desired torque range and the grinding process being a wet grinding process, the method further comprises:

decreasing a grinding pressure, and reducing a water feed rate.

16. The method as claimed in claim 10, wherein, responsive to a predetermined period elapsing, a re-measured torque is determined to be below a low torque threshold, or above a high torque threshold, the method further comprises prompting an operator of the floor grinding machine to:

change tool, or change grinding process from dry to wet or vice versa.

17. The method as claimed in claim 1, wherein determining the nominal value of the motor operating parameter comprises:

receiving a user input indicating that the grinding, polishing or milling is operating as desired, determining a current value of the motor operating parameter, and setting the nominal value of the motor operating parameter based on the determined current value of the motor operating parameter.

18. The method as claimed in claim 17, further comprising:

measuring the current value of the motor operating parameter for a predetermined time at the time of receipt of the user input, whereby a series of current values of the motor operating parameters are recorded, and setting the nominal value based on said series of current values.

* * * * *